US012127640B1

(12) United States Patent
Lu

(10) Patent No.: US 12,127,640 B1
(45) Date of Patent: Oct. 29, 2024

(54) WATCH BAND AND WATCH

(71) Applicant: Shenzhen Qipurui Technology Co., Ltd., Shenzhen (CN)

(72) Inventor: Haibing Lu, Shenzhen (CN)

(73) Assignee: Shenzhen Qipurui Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/433,293

(22) Filed: Feb. 5, 2024

(30) Foreign Application Priority Data

Jan. 30, 2024 (CN) ..... 202420233003.9

(51) Int. Cl.
*A44C 5/10* (2006.01)

(52) U.S. Cl.
CPC ..... *A44C 5/107* (2013.01)

(58) Field of Classification Search
CPC ..... A44C 5/107; A44C 5/105; A44C 5/14; A44C 5/145; A44C 5/147
See application file for complete search history.

(56) References Cited

U.S. PATENT DOCUMENTS 6,014,793 A * 1/2000 Howald ..... A44C 5/147 24/265 B
6,163,942 A * 12/2000 Liao ..... A44B 11/266 24/593.1
6,237,319 B1 * 5/2001 Amundsen ..... A44C 5/105 59/80
7,380,979 B2 * 6/2008 Hiranuma ..... A44C 5/14 368/282
10,359,739 B2 * 7/2019 Vuille ..... A44C 5/14
10,524,548 B2 * 1/2020 Park ..... A44C 5/025
11,930,896 B2 * 3/2024 Aoki ..... G04B 37/1486
2015/0107300 A1 * 4/2015 Chan ..... A44C 5/107 63/4
2022/0061475 A1 * 3/2022 Nakatsuka ..... A44C 5/147

FOREIGN PATENT DOCUMENTS

CN 108652146 A 10/2018
CN 215014127 U 12/2021
CN 217906609 U 5/2023

* cited by examiner

*Primary Examiner* — Jack W Lavinder
(74) *Attorney, Agent, or Firm* — Nitin Kaushik

(57) ABSTRACT

The present invention relates to the technical field of wearable devices, and in particular, to a watch band and a watch. The watch band includes: a plurality of sequentially connected chain elements, wherein a connecting portion and a connecting groove are provided on each of the chain elements, and the connecting portion is connected to the connecting groove on another adjacent chain element by means of a connecting mechanism; the connecting mechanism comprises a shifting block assembly and two ejector pin assemblies symmetrically provided at two sides of the shifting block assembly; an accommodating cavity and a placement groove penetrating the accommodating cavity are provided on the connecting portion; two oppositely arranged jacks are provided on the connecting groove; and the shifting block assembly is located in the accommodating cavity and the two ejector pin assemblies are located in the placement groove.

10 Claims, 5 Drawing Sheets

WATCH BAND AND WATCH

CROSS-REFERENCE TO RELATED APPLICATIONS

The application claims priority to Chinese patent application No. 2024202330039, filed on Jan. 30, 2024, the entire contents of which are incorporated herein by reference.

TECHNICAL FIELD

The present invention relates to the technical field of wearable devices, and in particular, to a watch band and a watch.

BACKGROUND

One connection means of commonly used connection structures for connecting chain elements of a watch band in the industry in the prior art uses a pin and a C-tube. The watch band is fixed through the interference fit between the pin and the C-tube, which poses high-level difficulties for the disassembly and assembly of the watch band, requiring special tools and certain skills. At the same time, the pin is easily bent and has to be scrapped during the disassembly and assembly process. After disassembly, the watch band is split into small parts, which are easily lost and damaged during disassembly and assembly.

Another connection means uses a spring bar with two shoulders respectively disposed at two ends of a circular straight tube and connected by a spring. The spring bar is retracted when the two shoulders at the two ends are pressed simultaneously and then the watch band can be removed, or the watch band can be secured by releasing the shoulders at the two ends. By this means, the disassembly and assembly process of the watch band actually reproduces the production and assembly process thereof. Special tools and certain skills are required for disassembly and assembly, and the watch band may be easily scratched if not operated properly.

There are still other connection means in the prior art to connect two chain elements, such as union pin connection and cotter pin connection. These connection means also require special tools for disassembly and assembly, and are very difficult to operate, making it challenging for ordinary users to handle.

SUMMARY

The present invention is intended to provide a watch band and a watch to solve the problems raised in the above background art.

To achieve the above objectives, the present invention provides a technical solution as follows:

a watch band, including:

a plurality of sequentially connected chain elements, wherein a connecting portion and a connecting groove are provided on each of the chain elements, and the connecting portion is connected to the connecting groove on another adjacent chain element by means of a connecting mechanism;

the connecting mechanism comprises a shifting block assembly and two ejector pin assemblies symmetrically provided at two sides of the shifting block assembly;

an accommodating cavity and a placement groove penetrating the accommodating cavity are provided on the connecting portion;

two oppositely arranged apertures are provided on the connecting groove;

the shifting block assembly is located in the accommodating cavity and the two ejector pin assemblies are located in the placement groove;

a retaining assembly is provided between the two ejector pin assemblies so that one end of the ejector pin assembly extends from the placement groove and is inserted into the aperture on another adjacent connecting groove to form a state of connection between two adjacent chain elements;

the shifting block assembly slides horizontally in the accommodating cavity and moves away from the two ejector pin assemblies, and the end of the ejector pin assembly inserted into the aperture on another adjacent connecting groove is retracted by a drive assembly from the aperture into the placement groove to change the state of connection between two adjacent chain elements to a state of disconnection; and the two ejector pin assemblies compress the retaining assembly when the state of connection between two adjacent chain elements is changed to the state of disconnection, so as to provide a force for resetting the shifting block assembly.

Further, the chain element includes a middle block and end blocks located on two sides of the middle block; the connecting groove is formed between the end blocks on the two sides, the two apertures are respectively provided on the two end blocks, and the connecting portion is provided on the middle block.

Further, the drive assembly includes two symmetrically arranged drive wheels with teeth; the shifting block assembly has teeth I on two sides; the two ejector pin assemblies have teeth II on the other end sides thereof, and the teeth I and the teeth II are respectively engaged with the teeth of the two drive wheels.

Further, the shifting block assembly includes a shifting block; the two ejector pin assemblies include two ejector pins; the teeth I on two sides are arranged on two sides of the shifting block; and two of the teeth II are respectively arranged on the other end sides of the two ejector pins.

Further, the drive assembly includes two symmetrically arranged pulleys and two rigid wire ropes; the pulleys are located close to the other end sides of the two ejector pin assemblies; one end of each of the two wire ropes is correspondingly connected to the two ejector pin assemblies; and the other end thereof is wound around the pulley and then connected to the shifting block assembly.

Further, the shifting block assembly includes a shifting block; the two ejector pin assemblies include two ejector pins; the two pulleys are respectively arranged on the other end sides of the two ejector pins; and one end of each of the two wire ropes is correspondingly connected to the two ejector pins.

Further, the middle block includes a top cover and a bottom cover mounted on the top cover.

Further, an elastic hook portion is provided on the inner side of the top cover and a hook groove fitting with the hook portion is provided on the outer side of the bottom cover.

Further, guide rails with a spacer are provided on the connecting portion; guide grooves adapted to slide with the guide rails are provided at the bottom of the shifting block; and a limiting protrusion matching the spacer is located in the guide grooves.

Further, the shifting block assembly further includes a cover plate sleeved on the shifting block, and the upper end face of the cover plate is slidingly connected to the inner wall of an opening in the accommodating cavity.

To achieve the above objectives, the present invention further provides a technical solution as follows:

a watch having the watch band as described in any one of the above.

Compared to the prior art, the present invention has the following beneficial effects:

according to the present invention, in the initial state, opposite ends of the two ejector pin assemblies respectively extend into the placement groove of the connecting portion on the chain element where they are located and are inserted into the aperture of the connecting groove on another adjacent chain element so that a connection can be established between the chain elements to form the watch band. When the shifting block assembly moves in translation in one direction, the shifting block assembly moves away from the two ejector pin assemblies. When the shifting block assembly slides horizontally in the accommodating cavity and moves away from the two ejector pin assemblies, the end of the ejector pin assembly inserted into the aperture on another adjacent connecting groove is retracted by a drive assembly from the aperture into the placement groove to change the state of connection between two adjacent chain elements to a state of disconnection, thereby achieving the disconnection of the two chain elements and making it convenient for users to disassemble and assemble the chain elements.

According to the present invention, the disassembly and assembly between two chain elements of the watch band are convenient and simple to operate, enabling users to perform the disassembly and assembly operations by themselves and easily adjust the length of the watch band to facilitate wearing.

Reference signs: 1: watch band; 2: chain element; 3: middle block; 4: end block; 5: accommodating cavity; 6: cover plate; 7: shifting block; 8: top cover; 9: bottom cover; 10: ejector pin; 11: drive wheel; 12: retaining assembly; 13: tooth II; 14: guide rail; 15: hook groove; 16: mounting pile; 17: placement groove; 18: aperture; 19: hook portion; 20: blind hole; 21: guide groove; 22: limiting protrusion; 23: spacer; 24: tooth I; 25: pulley; 26: wire rope; 27: connecting portion; 28: connecting groove; 29: shifting block assembly; 30: ejector pin assembly

DETAILED DESCRIPTION OF THE EMBODIMENTS

The technical solution in the embodiments of the present invention is clearly and completely described below with reference to the accompanying drawings in the embodiments of the present invention. Obviously, the described embodiments are merely some but not all of the embodiments of the present invention. All other embodiments obtainable by those skilled in the art based on the embodiments of the present invention without creative efforts fall within the protection scope of the present invention.

In the description of the present invention, it should be noted that the orientations or positional relationships indicated by the terms "top", "bottom", "inner", "outer", "front", "rear", "both ends", "one end", "the other end", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first" and "second" are used for descriptive purposes only and should not be construed as indication or implication of relative importance.

In the description of the present invention, it should be noted that unless otherwise explicitly provided and limited, the terms "mounted", "provided", "fitted", "sleeved", "connected", etc. should be understood in a broad sense, for example, a connection may be a fixed connection, a detachable connection or an integral connection; it may be a mechanical connection or an electrical connection; it may be a direct connection or an indirect connection via an intermediate medium; and it may be a connection between two elements. For those of ordinary skill in the art, the specific meanings of the above terms herein can be understood on a case-by-case basis.

Example 1

Figure 4:
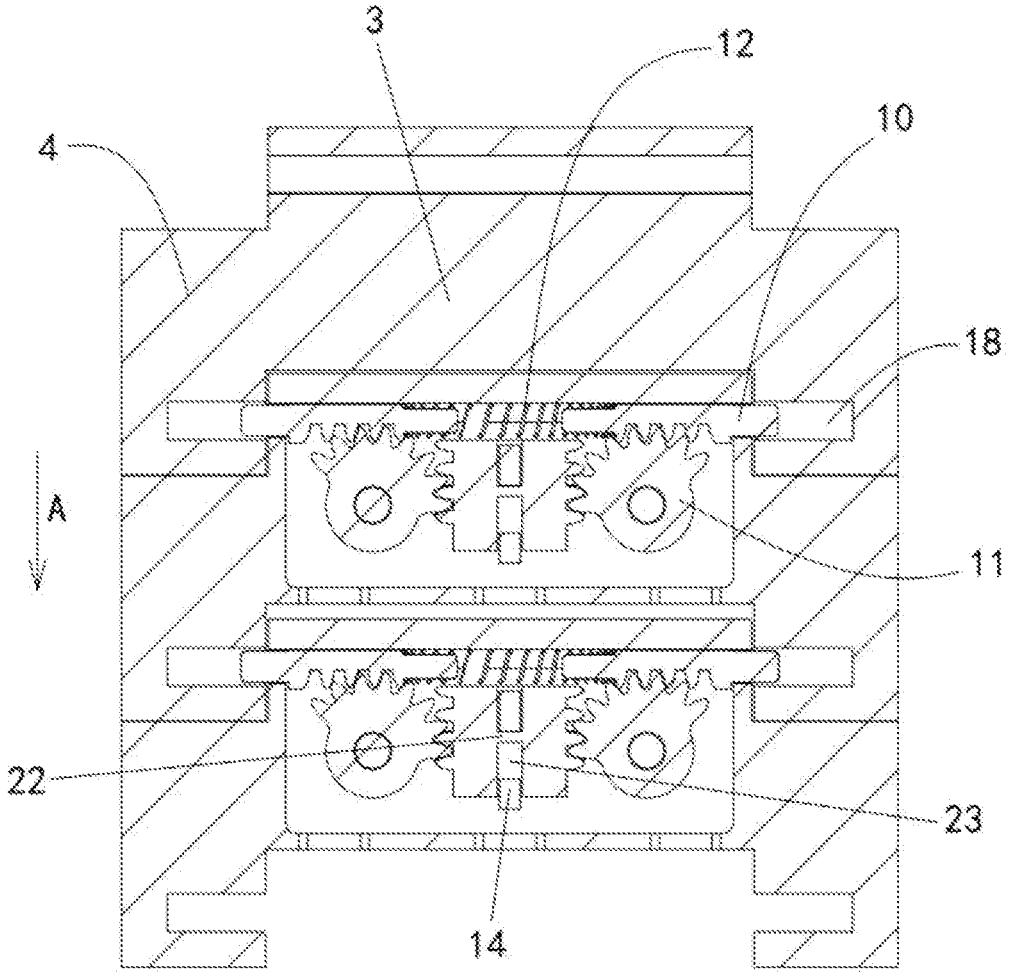
FIG. 4 is a schematic structural diagram of an initial position of a shifting block of the present invention when an ejector pin is inserted into an aperture to achieve a connection between chain elements.

Referring to FIGS. 1-4, the present invention provides a technical solution as follows:

a watch band 1, including:

a plurality of sequentially connected chain elements 2, wherein a connecting portion 27 and a connecting groove 28 are provided on each of the chain elements 2, and the connecting portion 27 is connected to the connecting groove 28 on another adjacent chain element 2 by means of a connecting mechanism; as shown in FIG. 4, the disassembly and assembly between two adjacent chain elements 2 can be achieved by means of the connecting mechanism.

The connecting mechanism includes a shifting block assembly 29 and two ejector pin assemblies 30 symmetrically provided at two sides of the shifting block assembly;

an accommodating cavity 5 and a placement groove 17 penetrating the accommodating cavity 5 are provided on the connecting portion 27;

two oppositely arranged apertures 18 are provided on the connecting groove 28; and the shifting block assembly 29 is located in the accommodating cavity 5 and the two ejector pin assemblies 30 are located in the placement groove (17); the connecting mechanism is arranged in the accommodating cavity 5 to ensure a neat appearance of the chain element 2 in overall and to avoid dust accumulation.

Preferably, the accommodating cavity 5 is arranged on the back of the watch band 1, that is, close to a wearer's wrist, which not only allows the accommodating cavity 5 to be blocked by the wearer's wrist but also contributes to the overall beauty of the watch band 1.

A retaining assembly 12 is provided between the two ejector pin assemblies 30 so that one end of the ejector pin assembly 30 extends from the placement groove 17 and is inserted into the aperture 18 on another adjacent connecting groove 28 to form a state of connection between two adjacent chain elements 2; in the initial state, opposite ends of the two ejector pin assemblies 30 respectively extend into the placement groove 17 of the connecting portion 27 on the chain element 2 where they are located and are inserted into the aperture 18 of the connecting groove 28 on another adjacent chain element 2 so that a connection can be established between the chain elements 2 to form the watch band 1.

Figure 1:
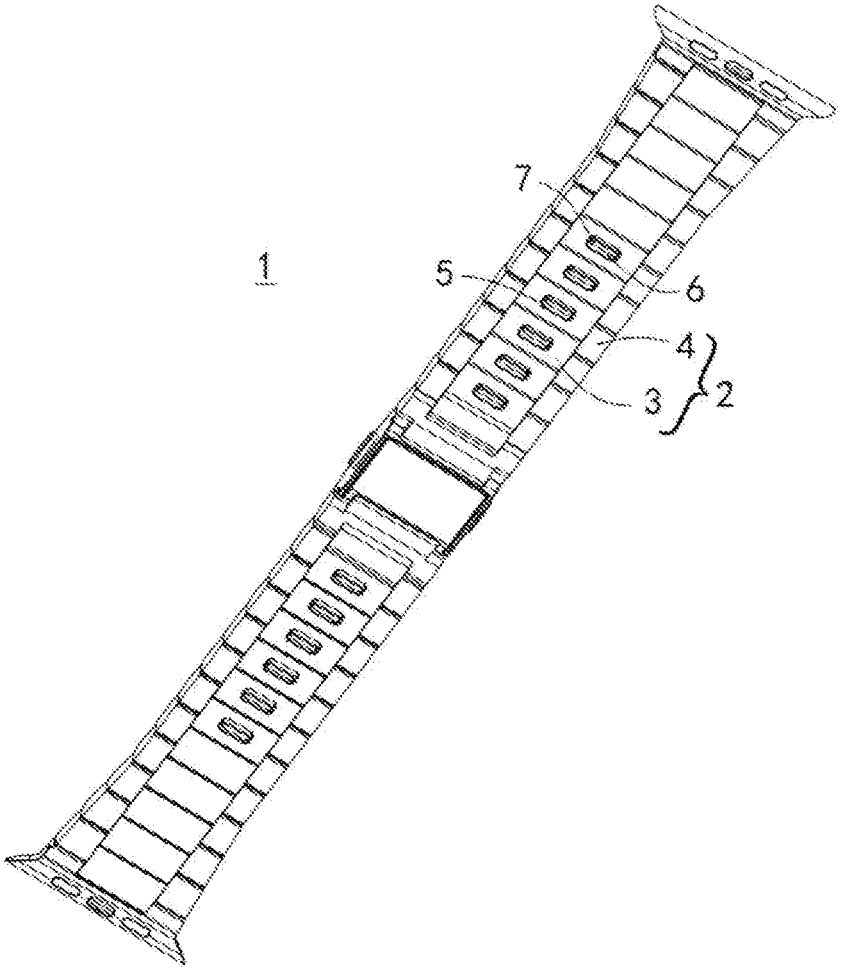
FIG. 1 is a schematic structural diagram of the present invention.
Figure 2:
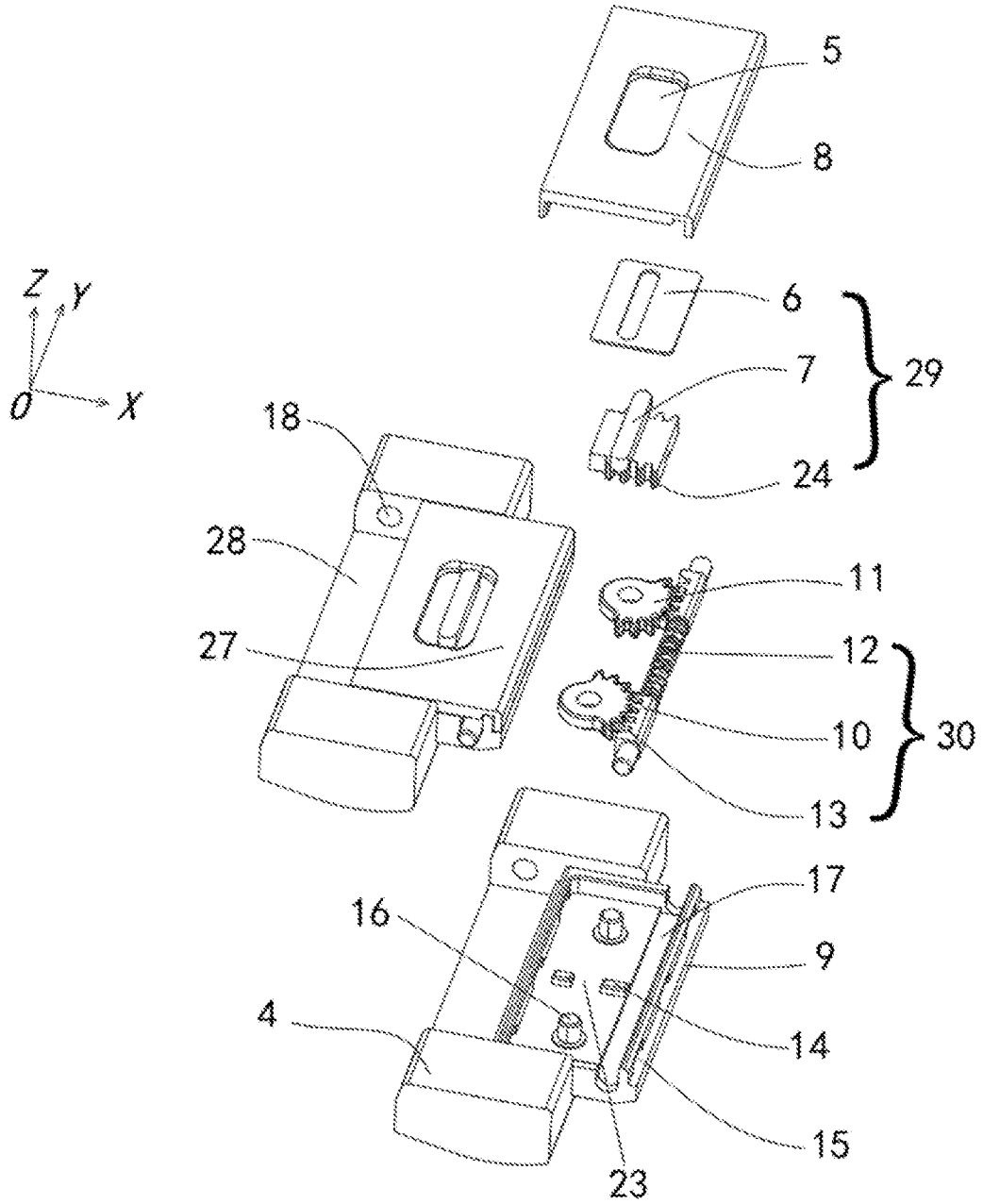
FIG. 2 is an exploded view of a chain element of the present invention.
Figure 3:
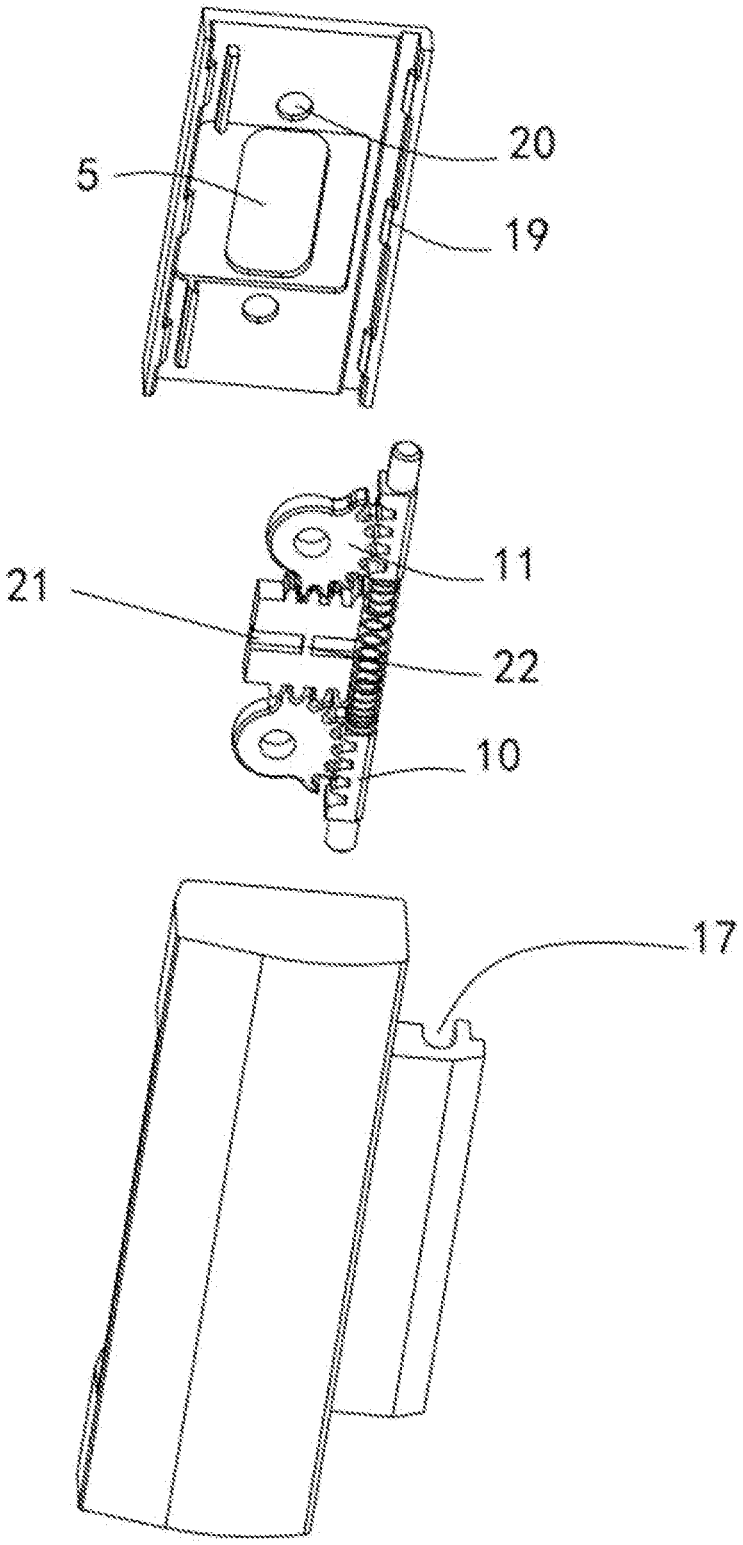
FIG. 3 is a schematic diagram of opening a bottom cover and a top cover of the present invention.

As shown in FIG. 2, the shifter assembly 29 moves in translation along the X-axis direction, specifically to the left: at this time, the shifter assembly 29 slides horizontally in the accommodating cavity 5 and moves away from the two ejector pin assemblies 30, and the end of the ejector pin assembly 30 inserted into the aperture 18 on another adjacent connecting groove 28 is retracted by a drive assembly from the aperture 18 into the placement groove 17 to change the state of connection between two adjacent chain elements 2 to a state of disconnection; and the two ejector pin assemblies 30 compress the retaining assembly 12 when the state of connection between two adjacent chain elements 2 is changed to the state of disconnection, so as to provide a force for resetting the shifting block assembly 29, and the retaining assembly 12 is a spring, specifically a compression spring. When opposite ends of the two ejector pin assemblies 30 are close to each other, the compression spring is compressed, thereby generating an elastic force that serves as the force for resetting the shifting block assembly 29, convenient for use.

Specifically, the chain element 2 includes a middle block 3 and two end blocks 4 located on two sides of the middle block 3; the connecting groove 28 is formed between the two end blocks 4, the two apertures 18 are respectively provided on the two end blocks 14, and the connecting portion 27 is provided on the middle block 3. The drive assembly includes two symmetrically arranged drive wheels 11 with teeth; the shifting block assembly 29 has teeth I 24 on two sides; the two ejector pin assemblies 30 have teeth II 13 on the other end sides thereof, and the teeth I 24 and the teeth II 13 are respectively engaged with the teeth of the two drive wheels 11.

Specifically, the shifting block assembly 29 includes a shifting block 7; the two ejector pin assemblies 30 include two ejector pins 10; the teeth I 24 on two sides are arranged on two sides of the shifting block 7; and two of the teeth II 13 are respectively arranged on the other end sides of the two ejector pins 10.

In this example, the accommodating cavity 5 is preferably square-shaped. Of course, other shapes can also be used, such as circular and hexagonal shapes. The ejector pin 10 (except for the position of the tooth II 13) is preferably cylinder-shaped. Of course, other shapes can also be used, such as a square shape.

In the initial state, the retaining assembly 12, preferably a compression spring, is in an uncompressed state. At this time, opposite ends of the two ejector pins 10 extend and are inserted into the aperture 18 of the connecting groove 28 on another adjacent chain element 2 to form a state of connection between the chain elements 2; as shown in FIG. 4, when the shifting block 7 is pushed by a finger to move in translation to the left along the X-axis direction, that is, the shifting block 7 moves in the direction indicated by the arrow A, the teeth I 24 at two sides of the shifting block 7 drive the two drive wheels 11 with teeth to rotate (specifically, the left drive wheel 11 rotates clockwise and the right drive wheel 11 rotates counterclockwise), and since the teeth of the two drive wheels are engaged with the teeth II 13, the two ejector pins 10 can be driven to move toward each other. In this way, the opposite ends of the two ejector pins 10 can be retracted from the aperture 18 of the connecting groove 28 on another adjacent chain element 2 into the placement groove 17 where they are located and the compression spring can be compressed, and then a disassembly operation can be conducted between the chain elements 2 so that the length of the watch band 1 can be easily adjusted to facilitate wearing.

In this example, the shifting block 7 is in an inverted T shape and the width of an upper protruding part thereof is smaller than that of an opening in the accommodating cavity 5 to facilitate the movement of the shifting block 7 in the accommodating cavity 5 through the protruding part, so that the two ejector pins 10 can be driven by the drive assembly to move toward each other. Further, the end face of the upper protruding part is flush with the upper end face of the opening in the accommodating cavity 5.

Specifically, guide rails 14 with a spacer 23 are provided on the connecting portion 27; guide grooves 21 adapted to slide with the guide rails 14 are provided the bottom of the shifting block 7; and a limiting protrusion 22 matching the spacer 23 is located in the guide grooves 21.

As shown in FIGS. 2 and 4, the guide rails 14 are provided on the connecting portion 27, and more specifically, the guide rails 14 are provided in the bottom cover 9; the guide grooves 21 are provided at the bottom of the shifting block 7; and through the cooperation of the guide rails 14 and the guide grooves 21, smooth movement of the shifting block 7 is achieved. Since the guide rail 14 has the spacer 23 in the middle and, correspondingly, the guide groove 21 has the limiting protrusion 22 in the middle, when the shifting block 7 is pushed by a finger to move to the left along the X-axis direction and the left side of the limiting protrusion 22 contacts the left side of the spacer 23, the opposite ends of the two ejector pins 10 can be fully retracted into the placement groove 17 where they are located; when the finger is released, under the action of the elastic force of the compression spring, the shifting block 7 moves to the right along the X-axis direction until the right side of the limiting protrusion 22 contacts the right side of the spacer 23 so that the opposite ends of the two ejector pins 10 extend again and are inserted into the aperture 18 on another adjacent connecting groove 28 and the shifting block 7 is fully reset.

Specifically, as shown in FIG. 2, the shifting block assembly 29 further includes a cover plate 6 sleeved on the shifting block 7, and the upper end face of the cover plate 6 is slidingly connected to the inner wall of an opening in the accommodating cavity 5. By providing the cover plate 6, the bottom cover 9 can be separated from the outside of the opening in the accommodating cavity 5 when the shifting block 7 moves left and right along the X-axis direction, thereby acting as a seal and preventing the middle block 3 from dust ingress and accumulation.

In this example, the middle block 3 includes a top cover 8 and a bottom cover 9 mounted on the top cover 8; an elastic hook portion 19 is provided on the inner side of the top cover 8; and a hook groove 15 fitting with the hook portion 19 is provided on the outer side of the bottom cover 9.

The top cover 8 and the bottom cover 9 form the middle block 3 with a hollow cavity structure, thereby facilitating the installation of the connecting mechanism and the drive assembly in the hollow cavity structure.

Mounting piles 16 are provided in the bottom cover 9 and the two drive wheels 11 with teeth are respectively sleeved on the mounting piles 16 correspondingly. Two blind holes 20 are provided in the inner wall of the top cover 8 to facilitate the insertion of the upper ends of the two mounting piles 16.

In this example, in order to facilitate the installation of the drive wheels 11 with teeth or to reduce the size of the middle block 3, the teeth of the drive wheel 11 occupy half of the wheel edge with the other half thereof being a smooth surface, that is, as shown in FIG. 4, the drive wheel 11 can be regarded as half a gear.

Example 2

Figure 5:
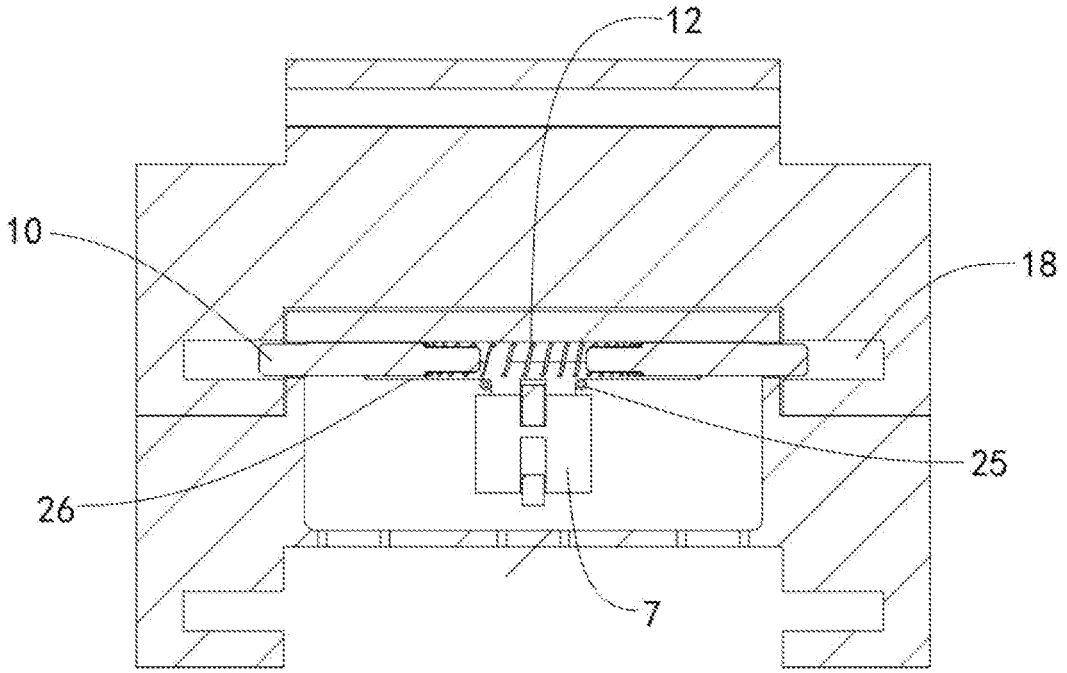
FIG. 5 is a schematic structural diagram of a connection between chain elements according to another embodiment of the present invention.

Referring to FIG. 5, it is substantially the same as Example 1 with slight differences as follows:

the drive assembly includes two symmetrically arranged pulleys 25 and two rigid wire ropes 26; the pulleys 25 are located close to the other end sides of the two ejector pin assemblies 30; one end of each of the two wire ropes 26 is correspondingly connected to the two ejector pin assemblies 30; and the other end thereof is wound around the pulley 25 and then connected to the shifting block assembly 29.

Specifically, the shifting block assembly 29 includes a shifting block 7; the two ejector pin assemblies 30 include two ejector pins 10; the two pulleys 25 are respectively arranged on the other end sides of the two ejector pins 10; and one end of each of the two wire ropes 26 is correspondingly connected to the two ejector pins 10.

In this example, when the shifting block 7 is pushed by a finger to move in the direction indicated by the arrow A as shown in FIG. 4, the two wire ropes 26 are driven to move so that opposite ends of the two ejector pins 10 can be retracted from the aperture 18 of the connecting groove 28 on another adjacent chain element 2 into the placement groove 17 where they are located and the compression spring can be compressed, and then a disassembly operation can be conducted between the chain elements 2.

When the finger is released, under the action of the elastic force of the compression spring, the opposite ends of the two ejector pins 10 extend again and are inserted into the aperture 18 on another adjacent connecting groove 28, the shifting block 7 is fully reset, and the state of connection formed again between the chain elements 2.

To smoothly pull the two ejector pins 10, the two symmetrical pulleys 25 are provided on the side of the shifting block 7 close to the compression spring (retaining assembly 12) and the two wire ropes 26 are respectively wound around the pulleys 25, with one end thereof connected to the two ejector pins 10 and the other end thereof connected to the shifting block 7. The pulley 25 is used as a guide for the wire rope 26 to achieve the extension and retraction of the two ejector pins 10, so as to facilitate the assembly and disassembly between the chain elements 2. The wire rope 26 can be made of a thin steel wire with tensile strength and is arranged along the axial direction of a side of the ejector pin 10. Of course, in order not to interfere with the movement of the ejector pin 10 in the placement groove 17 when the wire rope 26 is pulled, a wire groove (not shown in the figure) for accommodating the wire rope 26 can be provided at the side of the ejector pin 10 to ensure the smooth extension and retraction of the ejector pin 10.

The present invention further provides a watch having the watch band 1 in the above-described Example 1 or 2, wherein the disassembly and assembly between two chain elements 2 of the watch band 1 are convenient and simple to operate, enabling users to perform the disassembly and assembly operations by themselves and easily adjust the length of the watch band 1 to facilitate wearing.

Those undescribed herein are known in the prior art.

Although the embodiments of the present invention have been shown and described, those of ordinary skill in the art will understand that various changes, modifications, replacements, and variations can be made to these embodiments without departing from the principle and spirit of the present invention, and the scope of the present invention is defined by the appended claims and their equivalents.

What is claimed is:

1. A watch band (1), comprising:

a plurality of sequentially connected chain elements (2), wherein a connecting portion (27) and a connecting groove (28) are provided on each of the chain elements (2), and the connecting portion (27) is connected to the connecting groove (28) on an adjacent chain element of the plurality of sequentially connected chain elements (2) by means of a connecting mechanism;

the connecting mechanism comprises a shifting block assembly (29) and two ejector pin assemblies (30) symmetrically provided at two sides of the shifting block assembly;

an accommodating cavity (5) and a placement groove (17) penetrating the accommodating cavity (5) are provided on the connecting portion (27);

two oppositely arranged apertures (18) are provided on the connecting groove (28);

the shifting block assembly (29) is located in the accommodating cavity (5) and the two ejector pin assemblies (30) are located in the placement groove (17);

a retaining assembly (12) is provided between the two ejector pin assemblies (30) so that one end of each of the ejector pin assemblies (30) extends from the placement groove (17) and is inserted into the aperture (18) on another adjacent connecting groove (28) to form a state of connection between two adjacent chain elements (2);

the shifting block assembly (29) slides horizontally in the accommodating cavity (5) and moves away from the two ejector pin assemblies (30), and the one end of each of the ejector pin assemblies (30) inserted into the aperture (18) on another adjacent connecting groove (28) is retracted by a drive assembly from the aperture (18) into the placement groove (17) to change the state of connection between two adjacent chain elements (2) to a state of disconnection; and the two ejector pin assemblies (30) compress the retaining assembly (12) when the state of connection between two adjacent chain elements (2) is changed to the state of disconnection, so as to provide a force for resetting the shifting block assembly (29).

2. The watch band according to claim 1, wherein each of the plurality of sequentially connected chain elements (2) comprises a middle block (3) and end blocks being located on a side of two opposing sides of the middle block (3); the connecting groove (28) is formed between the end blocks (4), each of the end blocks comprise one of the two apertures, and the connecting portion (27) is provided on the middle block (3).

3. The watch band according to claim 2, wherein the middle block (3) comprises a top cover (8) and a bottom cover (9) mounted on the top cover (8); an elastic hook portion (19) is provided on an inner side of the top cover (8); and a hook groove (15) fitting with the elastic hook portion (19) is provided on an outer side of the bottom cover (9).

4. The watch band according to claim 1, wherein the drive assembly comprises two symmetrically arranged drive wheels (11) with first set of teeth; the shifting block assembly (29) has second set of teeth (24) on two sides; the two ejector pin assemblies (30) have third set of teeth (13) on the other end sides thereof, and the second set of teeth (24) and the third set of teeth (13) are respectively engaged with the first set of teeth of the two drive wheels (11).

5. The watch band according to claim 4, wherein the shifting block assembly (29) comprises a shifting block (7); the two ejector pin assemblies (30) comprise two ejector pins (10); the second set of teeth (24) on two sides are arranged on two sides of the shifting block (7); and two of the third set of teeth (13) are respectively arranged on a side of each of the two ejector pins (10).

6. The watch band according to claim 5, wherein guide rails (14) with a spacer (23) are provided on the connecting portion (27); guide grooves (21) adapted to slide with the guide rails (14) are provided at a bottom of the shifting block (7); and a limiting protrusion (22) matching the spacer (23) is located between the guide grooves (21).

7. The watch band according to claim 5, wherein the shifting block assembly (29) further includes a cover plate (6) sleeved on the shifting block (7), and an upper end of the cover plate (6) is slidingly connected to an inner wall of an opening in the accommodating cavity (5).

8. The watch band according to claim 1, wherein the drive assembly comprises two symmetrically arranged pulleys (25) and two wire ropes (26); the two symmetrically arranged pulleys (25) are located close to an end opposed to the one end of the two ejector pin assemblies (30); one end of each of the two wire ropes (26) is correspondingly connected to the two ejector pin assemblies (30); and the other end of each of the two wire ropes is correspondingly wound around each of the two symmetrically arranged pulleys (25) and then connected to the shifting block assembly (29).

9. The watch band according to claim 8, wherein the shifting block assembly (29) comprises a shifting block (7); the two ejector pin assemblies (30) comprise two ejector pins (10); the two symmetrically arranged pulleys (25) are respectively arranged adjacent an end opposed to the one end of each of the two ejector pins (10); and one end of each of the two wire ropes (26) is correspondingly connected to the two ejector pins (10).

10. A watch having the watch band (1) as described in the claim 1.

* * * * *